United States Patent [19]

Bartis

[11] Patent Number: 4,919,289

[45] **Date of Patent: * Apr. 24, 1990**

[54] PORTABLE STORAGE TANK

[76] Inventor: Peter A. Bartis, 105 East View Terr., Meriden, Conn. 06450

[ * ] Notice: The portion of the term of this patent subsequent to Jan. 28, 2006 has been disclaimed.

[21] Appl. No.: 318,233

[22] Filed: Mar. 3, 1989

Related U.S. Application Data

[63] Continuation-in-part of Ser. No. 135,058, Dec. 18, 1987, Pat. No. 4,815,621.

[51] Int. Cl.[5] ..... B65D 90/00

[52] U.S. Cl. ..... 220/1 B; 220/85.5

[58] Field of Search ..... 220/1 B, 85 R, 85 S, 220/202, 203, 208, 469, 5 A, 18

[56] References Cited

U.S. PATENT DOCUMENTS

| | | | |
|---|---|---|---|
| 1,494,780 | 5/1984 | Ford | 220/5 A |
| 1,716,950 | 6/1929 | Day | 220/85 B |
| 2,955,723 | 10/1960 | McGrath | 220/20.5 |
| 3,791,164 | 2/1974 | Laverman | 220/18 |
| 3,848,765 | 11/1974 | Durkop | 220/18 |
| 3,989,155 | 11/1976 | Conklin | 220/85 R |
| 4,114,783 | 9/1978 | Wempe et al. | 220/85 S |
| 4,456,141 | 6/1984 | Pamment | 220/335 |
| 4,629,087 | 12/1986 | Lenz | 220/5 A |
| 4,638,920 | 1/1987 | Goodhues Jr. | 220/85 S |
| 4,815,621 | 3/1989 | Bartis | 220/1 B |

*Primary Examiner*—David T. Fidei

*Attorney, Agent, or Firm*—Bachman & LaPointe

[57] ABSTRACT

The present invention relates to an above-ground double wall portable container for storing liquid products. The container has a primary tank for holding liquid, a secondary tank substantially surrounding the primary tank for containing the stored liquid in the event of a failure in the primary tank, a removable cover for closing the secondary tank and a sealable inlet box through which liquid is introduced into and withdrawn from the primary tank. The container also has a novel system for securing the cover to the tank(s). The system includes a flange member associated with at least one of the tanks, at least one aperture in the flange member which forms a mating set of apertures with at least one aperture in the cover, a fastener for each mating set of apertures, and a clip member for engaging each fastner.

15 Claims, 3 Drawing Sheets

PORTABLE STORAGE TANK

CROSS REFERENCE TO RELATED APPLICATIONS

This is a continuation-in-part application of co-pending, allowed U.S. patent application Ser. No. 135,058, filed Dec. 18, 1987 now U.S. Pat. No. 4,815,621.

BACKGROUND OF THE INVENTION

The present invention relates to an above-ground, portable, double-walled container for storing waste liquids and to means for safely securing the cover of the container to the paste liquid storage tank(s).

Underground storage tanks are currently used to store petroleum products such as gasoline, crude oil and heating oil as well as chemicals listed on the Environmental Protection Agency's hazardous substance list. Contamination of ground water from these underground storage tanks has become a serious problem. Antiquated steel tanks lacking corrosion protection, leak detection devices and spill prevention devices are a prime source of this form of pollution.

The U.S. Environmental Protection Agency has proposed new regulations to prevent contamination from such underground storage tanks. These regulations require that all newly installed underground tanks be protected from corrosion. An underground steel tank must be cathodically protected and coated with corrosion-resistant materials. Other tanks must be made totally of a non-corrodible material such as fiberglass or of a composite of steel and non-corrodible material. The materials in the tank must also be electrolytically compatible with the stored product. All tanks must also have leak-detection systems that provide monitoring at least every 30 days and devices that prevent spills and overfills. Additionally, tanks used to store hazardous chemicals must have dual or secondary containment tanks and leak detection systems installed between the inner and outer tanks.

Owners of underground tanks have begun to seek other methods of storage because of these and other onerous environmental regulations. These other methods have included the smaller and temporary above-ground use of 55 gallon drums and 275 gallon basement fuel tanks. Unfortunately, the use of these drums and tanks has not been without problems. Due to the absence of adequate corrosion protection, these drums and tanks have developed serious leaks. Containment dikes have been built around these above-ground tanks to collect the leaked contaminated liquids. These dikes, however, have caused other problems. For example, the dikes often become filled with rain water. Any additional leakage from the tanks simply overflows the sides. If the drums or tanks are empty, they often float or capsize in the filled dikes. Drains have been installed to allow collected water to be withdrawn, but if the drain plugs are inadvertently let loose or not replaced, they served no useful purpose. In most cases, the dikes create more problems than they solve. There is still a need for suitable alternative above-ground waste storage tanks.

Accordingly, it is an object of the present invention to provide a storage tank which is both practical and convenient.

It is a further object of the present invention to provide a storage tank as above which complies with and in most cases exceeds environmental regulations.

It is still a further object of the present invention to provide a storage tank as above having improved means for safely securing the tank cover to the waste liquid storage tank(s).

These and other objects and advantages will become more apparent from the following description and drawings in which like reference numerals depict like elements.

SUMMARY OF THE INVENTION

The present invention relates to an above-ground portable container for storing liquids such as new and waste petroleum products including but not limited to motor vehicle and crankcase drain oil, transmission fluid, hydraulic oil, paraffin or synthetic base lubricating oil, No. 2 fuel oil, No. 4 fuel oil and cutting oil, as well as other products. The container has a primary tank for holding liquid, a secondary tank substantially surrounding the primary tank for containing the stored liquid in the event that the primary tank fails, a removable cover closing the secondary tank and an improved arrangement for securing the cover to at least the secondary tank. The container also includes a tamper proof, multi-purpose pouring inlet box through which liquid can be introduced into and withdrawn from the primary tank. The inlet box includes a screen for removing debris from liquid as it is being introduced, at least one aperture for allowing vapors to vent from the interior of the tanks to the atmosphere, and a conduit for withdrawing liquid from the primary tank.

The improved arrangement for securing the cover to one or more of the tanks includes a flange member joined to or formed integrally with at least one of the tanks and one or more apertures in each flange member which align with one or more apertures in the cover so as to form a mating set of apertures. A fastener for joining the cover to the tank(s) is passed through each mating set of apertures. To secure the fastener and thus the cover in its closed position, one or more clip members are provided to engage a threaded portion of each fastener.

DETAILED DESCRIPTION

Figure 1:
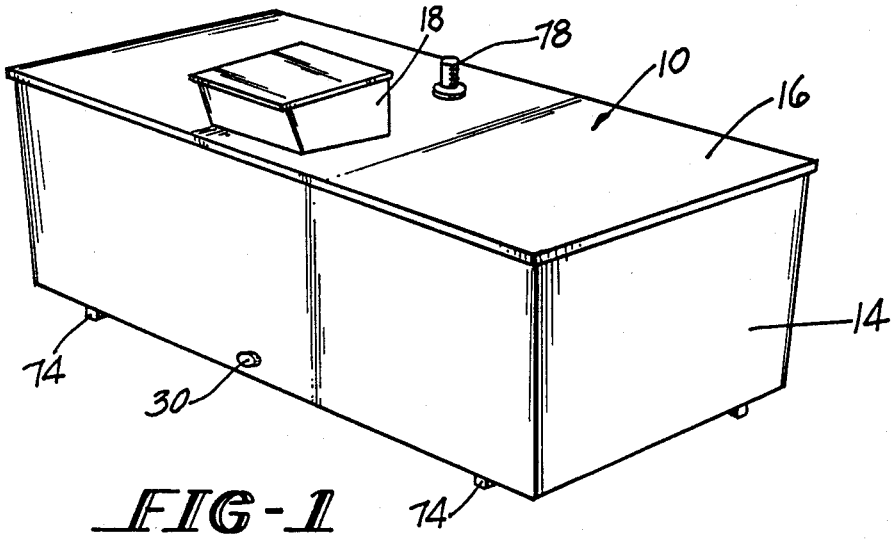
FIG. 1 is a perspective view of a storage tank in accordance with the present invention.
Figure 2:
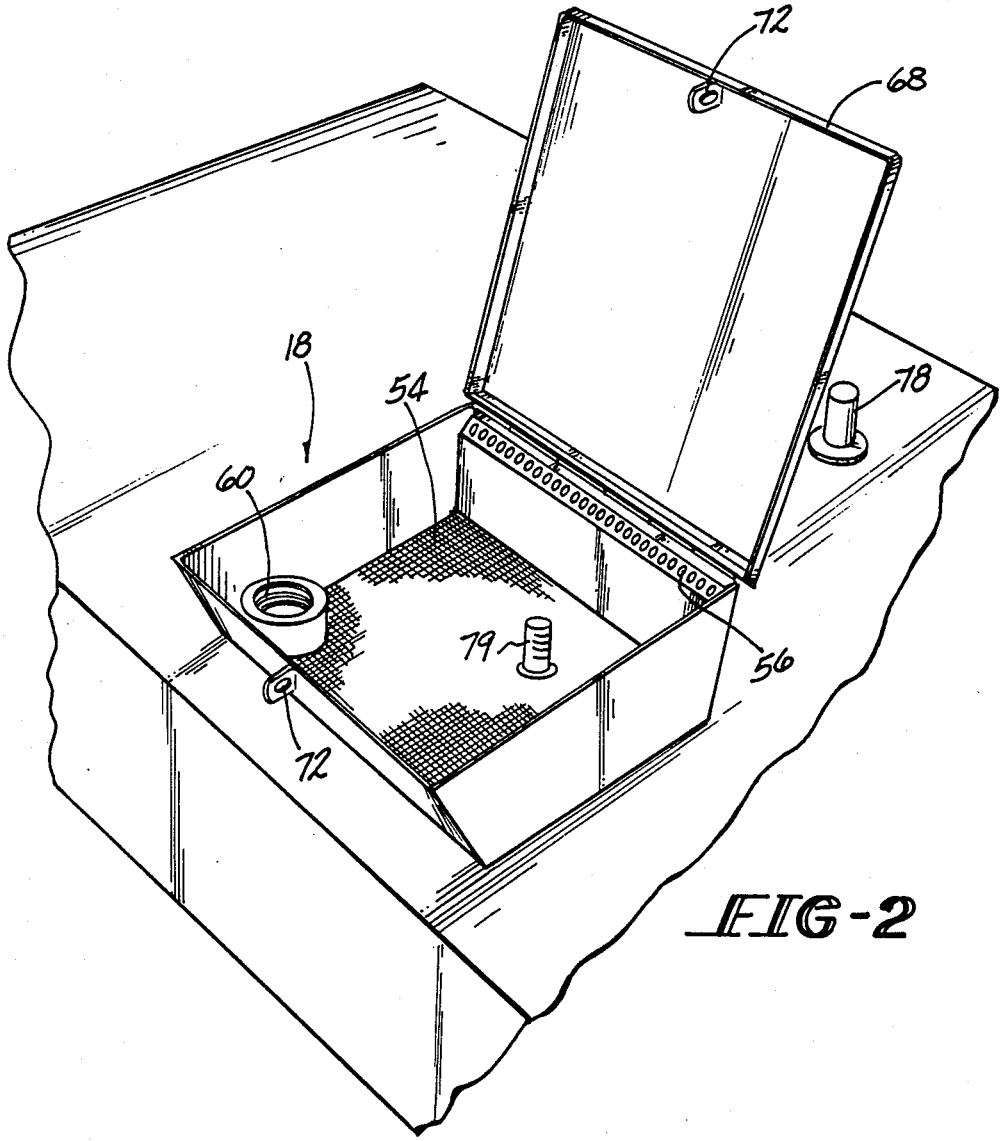
FIG. 2 is a perspective view of the inlet box attached to the top of the storage tank cover.
Figure 3:
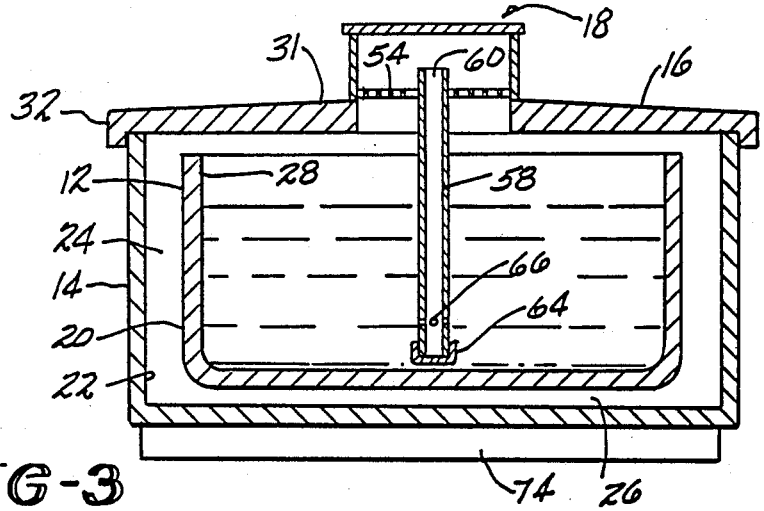
FIG. 3 is an end view of the storage tank of FIG. 1 in cross section.
Figure 4:
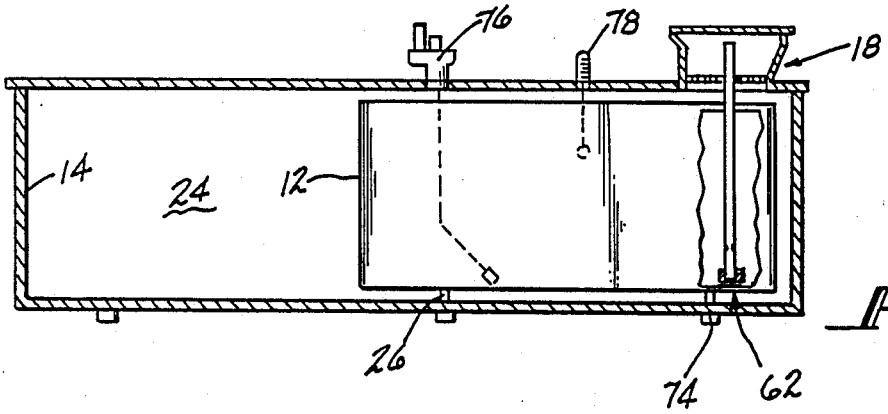
FIG. 4 is a side view of the storage tank of FIG. 1 in cross section.

Referring now to the Figures, the self-contained, packaged, above-ground, portable double-wall liquid storage container 10 of the present invention includes an inner primary liquid storage tank 12, an outer containment tank 14, a removable cover 16 and a multi-purpose inlet box 18. As best shown in FIGS. 3 and 4, the inner tank 12 is substantially surrounded by the outer tank 14. The exterior surfaces 20 of the tank 12 are preferably spaced from the interior surfaces 22 of the tank 14 so as to create a secondary liquid containment space 24. The tank 12 may be supported within the tank 14 in any desired manner. For example, the tank 12 may be mounted on supports 26.

The inner storage tank 12 may comprise any suitable tank known in the art having any desired shape. For example, it could be an open top, vat type tank such as that shown in FIG. 3 constructed from steel, stainless steel, carbon steel, plastic materials such as polypropylene, polyvinylchloride and polyethylene, composites of the foregoing materials, or any other suitable material. When an open tank is utilized, the interior and exterior surfaces 28 and 20, respectively, are preferably finished with a suitable corrosion resistant coating such as textured lacquer or alkyed enamel. Alternatively, the tank 12 could be a closed type tank constructed from any of the aforementioned materials. When a closed tank construction is used, only the exterior surfaces 20 are finished with a corrosion resistant coating.

The outer containment tank 14 may also comprise any suitable open top, vat type tank known in the art having any desired shape and formed from any suitable material. For example, the tank 14 could be rectangular in shape and could be formed from welded steel, carbon steel, stainless steel, polypropylene, or molded polyethylene resin. To help protect a metallic version of tank 14 from corrosion, all surfaces of the metallic tank are smoothed, cleaned, primed and finished with a corrosion resistant coating. A leak indicator 30 such as a cavity sight glass visual leak indicator is mounted in one of the walls of tank 14 to allow periodic leak detection inspections.

The removable cover 16 is provided to seal the open secondary containment tank 14 and the inner tank 12 if it is open. The cover 16 is preferably formed from steel, carbon steel, or stainless steel whose surfaces have been finished with a corrosion resistant coating. Alternatively, the cover may be formed from plastic materials such as polypropylene and molded polyethylene resin.

The cover 16 is characterized by a slightly domed central portion 31 and a turned down lip portion 32 which serves in part as a drip edge. The lip portion also serves to prevent unwanted access to the interior of tank(s) 12 and/or 14 as well as to provide an aesthetic appearance to the container by concealing the cover securing system. An improved system for securing the cover 16 to the tank(s) 12 and/or 14 in accordance with the present invention will be described in more detail hereinafter.

A rectangularly shaped inlet box 18 is mounted to the cover 16. Liquid such as used motor oil to be stored in the container 10 is introduced into the tank 12 through the inlet box 18. Similarly, liquid is withdrawn from the tank 12 via a conduit 58 which extends from the tank 12 to the inlet box 18.

The inlet box 18 may be mounted to the cover 16 in any desired manner. For example, the inlet box 18 may be welded or screwed to the cover 16. Alternatively, it may be remotely mounted to the cover 16. Still further, it could be recessed into the cover 16.

In a preferred embodiment, the box 18 houses a screen 54 for removing debris from liquid being introduced into the container 10 and a plurality of apertures 56 for permitting vapors within the tank(s) 12 and/or 14 to vent to the atmosphere. The conduit 58 which extends from the tank 12 to the box 18 preferably passes through a suitable opening in the debris screen 54. If desired, a gauge 79 for measuring he level of the liquid in the tank may be housed in the inlet box 18 to prevent vandalism.

The conduit 58 in the box 18 is provided with a threaded port 60 to enable the conduit to be connected to a suitable suction device not shown for withdrawing liquid from the tank 12. The end 62 of the conduit opposed to the port 60 is preferably closed by a cap 64 to prevent damage to the interior of the tank 12 from heavy materials inadvertently passing through conduit 58. The cap 64 may be threadably mounted to the conduit 58. Liquid to be withdrawn from the tank 12 may flow into the conduit 58 via a series of inlet ports 66 located about the periphery of conduit 58 adjacent cap 64. If desired, the ports 66 could form part of the cap structure. Alternatively, if the tank 12 is formed from a material which is highly resistant to impact, the cap 64 may be omitted if desired.

To permit the inlet box 18 to be sealed and locked and thereby prevent unauthorized use and vandalism, an oversized lid 68 is hinged to the back wall of the box. The rotation of the lid 68 may be limited by a suitable stop not shown. The lid 68 and the front wall of the box each have suitable means such as eyes 72 for receiving a lock 70.

The container 10 is mounted on supports 74 to permit easy movement by a pallet truck or forklift and to space the bottom of the container from the ground. The supports 74 may be formed either by C-shaped channels or open ended rectangular tubing fastened to the bottom of the outer tank 14. If an open ended channel or tubing is used for the support 74, it should be capable of receiving a forklift tine.

If desired, the container 10 may be provided with a combination vent/level gauge 76 to indicate the level of liquid in tank 12 and/or an overflow indicator 78. The gauge 76 and the indicator 78 are desirable because they assist in preventing overflows and spills of the liquid in tank 12. The vent portion of the gauge 76 is useful in providing additional means for venting vapors in the tank(s) to the atmosphere.

In lieu of the combination vent/level gauge 76, a level gauge such as that shown in allowed parent application Ser. No. 135,058, filed Sept. 18, 1987 may be positioned and concealed within the inlet box 18. The gauge may comprise any suitable gauge known in the art and may be secured to the bottom of the inlet box in any desired manner such as by a N.P.T. half-coupling welded to the bottom of the box and/or the screen. Such an arrangement is useful if one wants to conceal the level gauge.

The container 10 may also be provided with an emergency valve such as that shown in allowed parent application Ser. No. 135,058, filed Sept. 18, 1987, which is incorporated by reference herein, for venting any overpressure within the tanks 12 and 14.

Figure 5:
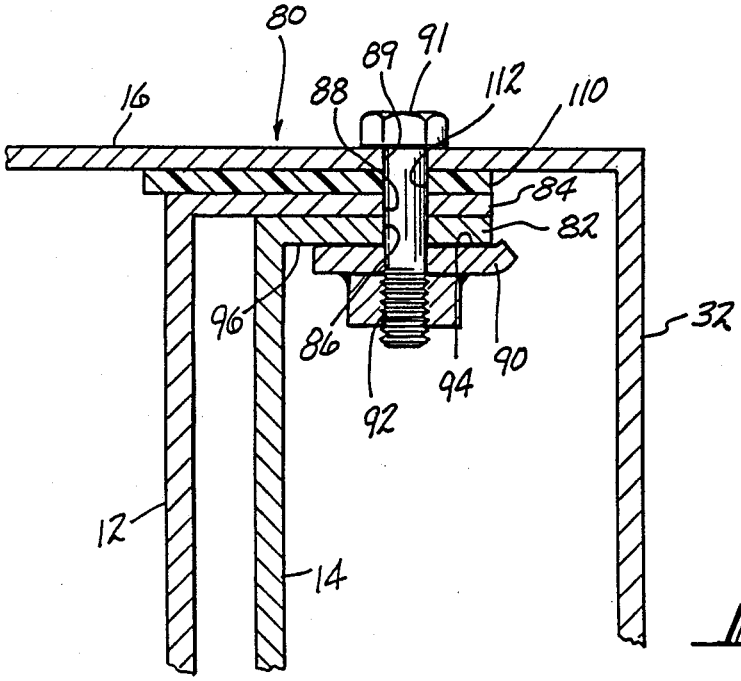
FIG. 5 is a partial cross-sectional view of the tank of FIG. 1 illustrating a first embodiment of the cover securing system of the present invention.

Referring now to FIG. 5 of the drawings, a first embodiment of a system for safely securing the cover 16 to the tanks 12 and/or 14 is illustrated. The system 80 as shown therein includes a flange member 82 formed integrally with the tank 14 so as to extend in a direction toward the lip portion 32. The flange member 82 if desired may extend about substantially the entire periphery of tank 14. Alternatively, one or more flange members may be formed on selected portions of the tank, for example on two opposed side walls of the tank. Each flange member 82 is provided with one or more apertures 86 which correspond in position to one or more apertures 89 in the cover 16.

The system 80 further includes a second flange member 84 formed integrally with the tank 12 so as to extend in a direction toward the cover lip portion 32. As with flange member 82, the flange member 84 may extend about the entire periphery of the tank 12 or may be formed on selected portion of the tank. As can be seen from FIG. 5, each flange member 84 overlaps the flange member 82 and contains one or more apertures 88 which align with the aperture(s) 86 in flange member 82 and the aperture(s) 89 in cover 16. When aligned, the aperture(s) 86, 88 and 89 form one or more sets of mating apertures.

A fastener 91, such as a threaded bolt or screw us passed through each set of mating apertures to secure the cover in position, the system 80 further includes one or more clip members 90 for engaging the fastener(s) 91 passing through the aligned apertures. Each clip member 90 has a threaded bore 92 for engaging a threaded portion of a fastener The clip(s) 90 can be formed from either a metallic or plastic material. Each one is preferably positioned beneath the lower surface 96 of the flange member 82. If desired, a washer not shown such as a lock washer, star washer, or the like may be positioned intermediate the surface 96 and an upper contact surface 94 of the clip 90.

Figure 6:
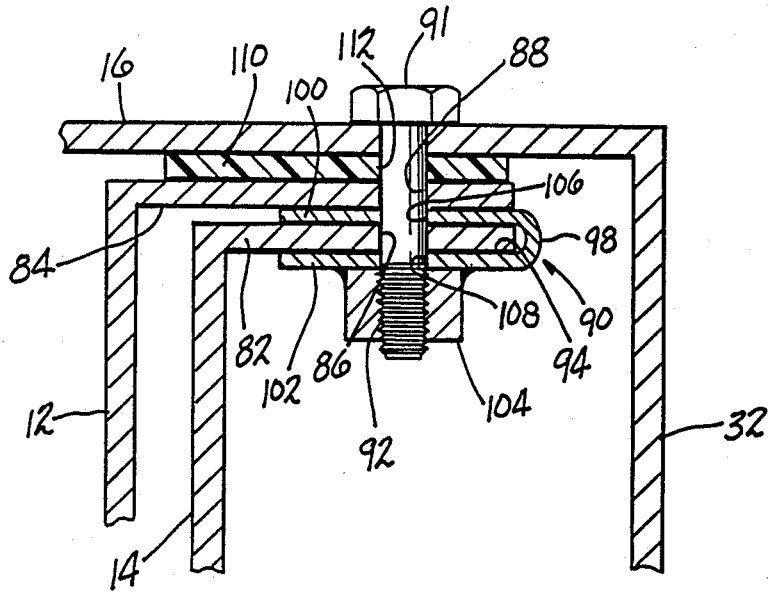
FIG. 6 is a partial cross-section view of the tank of FIG. 1 illustrating an alternative embodiment of the cover securing system of the present invention.

If desired, the clip 90 may have a substantially U-shaped segment 98 such as that shown in FIG. 6. The segment 98 may have two leg portions 100 and 102 which overlap a portion of the flange member 82. The leg portion 100 preferably extends between flange members 82 and 84 while the leg portion 102 forms a flange member contact surface 94. In this arrangement, a member 104 having a threaded bore 92 for engaging the fastener is either joined to such as by welding or integrally formed with the leg portion 102 of the clip.

The leg portions 100 and 102 are each provided with an aperture 106 and 108 respectively. The apertures 106 and 108 are alignable with respective ones of apertures 86 and 88 to allow a single fastener 91 to join the various system components together.

The system 80 may also include a pressure sensitive gasket 110 located intermediate the cover 16 and the flange member 84. The gasket can be formed from any suitable material such as rubber, neoprene or the like. The gasket may extend about substantially the entire periphery of the tank 12 or may be positioned in only desired locations. Of course, the gasket 110 is provided with one or more apertures 112 through which fastener(s) 91 can pass.

The cover 16 is secured in its closed position by passing a fastener 91 through the aligned apertures in each set of mating apertures and thereafter engaging the threaded bore portion of a clip member. Although only one set of apertures has been illustrated, any desired number of sets of mating apertures and fasteners may be used to secure the cover to the tanks 12 and/or 14.

Figure 7:
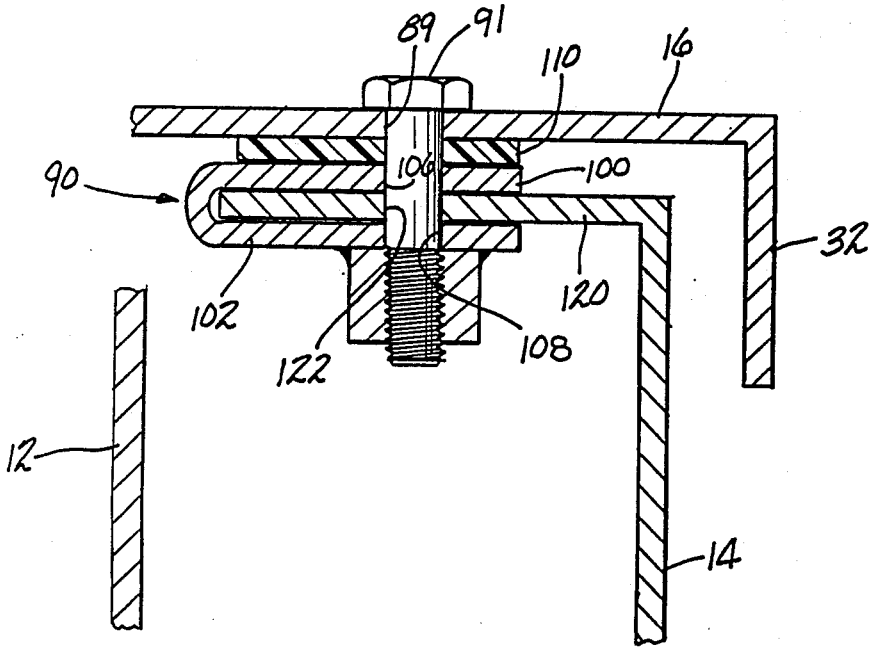
FIG. 7 is a partial cross-sectional view of the tank of FIG. 1 illustrating still another embodiment of the cover securing system of the present invention.

FIG. 7 illustrates another approach for securing the cover 16. In this approach, only the secondary tank 14 has an integrally formed flange member 120. The flange member 120 preferably extends inwardly toward the central portion of the tank. As before, the flange member 120 may extend about substantially the entire periphery of the tank or may be situated in only selected tank portions such as along opposed tank side walls. As in the earlier system, the flange member 120 is provided with One Or more apertures 122 which align With the aperture(s) 89 in the cover 16. In this approach, a portion of the flange member 120 is surrounded by a substantially U-shaped clip member 90 identical to that shown in FIG. 6.

The cover 16 is secured in position by passing a fastener 91 through the aligned apertures 89, 106, 108, 122 and engaging the threads on the fastener with the threaded bore portion of clip member 90.

If desired, a pressure sensitive gasket 110 may be positioned intermediate the cover 16 and the upper surface of clip member leg portion 100.

It has been found that the cover securing system of the present invention has several advantages. First and most important, it safely secures the cover in its closed position. Second, it is relatively easy to secure the cover to the tank(s). For example, the cover can be secured in position using a minimal number of tools.

While the flange members in the cover securing systems have been described as being integrally formed with the tank(s) 12 and/or 14, it should of course be realized that each flange member could be a separate right angled member fastened to the side walls of the tanks 12 and/or 14.

The inner tank 12 of container 10 may have any desired capacity. Typical storage capacities are in the range of from about 90 to about 475 U.S. gallons. To provide adequate containment capacity, the outer tank 14 should have a capacity which is from about 1% to about 110% greater than the volumetric capacity of the inner tank 12.

To prevent liquid from leaking out of the container 10, appropriate sealants such as silicone and suitable gasket materials such as Buna-N may be used between the cover 16 and the tanks 12 and/or 14.

While it is preferred to use visual leak indicators, other types of leak indicators such as aural alarms may be used if desired.

As can be seen from the foregoing discussion, the problem of safely storing liquid waste economically and efficiently is solved by the above-ground, double wall portable tank of the present invention. The hassle of inspections, leak detectors, and certification of underground storage tank has now been completely eliminated. In addition, the present invention overcomes the problems of unauthorized use, vandalism, and ease of use. The inlet box of the present invention may be placed at waist level thereby eliminating reaching or climbing up makeshift stairs.

It is apparent that there has been provided in accordance with this invention an above-ground portable storage tank which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A container for storing liquids which comprises:

a primary tank for holding liquid to be stored;

a secondary tank substantially surrounding said primary tank, said secondary tank containing said stored liquid in the event of the failure of said primary tank;

a cover for closing at least said secondary tank;

means for securing said cover to at least one of said tanks;

said cover securing means including a flange member associated with at least one of said tanks, at least one aperture in said flange member, at least one aperture in said cover, each said cover aperture being alignable with a flange aperture so as to form a mating set of apertures, a fastener passing through each said mating set of apertures and means for engaging said fastener so as to fix said cover in said closed position; and an inlet box attached to said cover, said inlet box having means for introducing liquid into and for withdrawing liquid from said primary tank and means for preventing access to said liquid introducing and withdrawing means.

2. A container in accordance with claim 1 which further comprises:

vent means in said inlet box for permitting vapors within said tanks to vent to the atmosphere.

3. A container in accordance with claim 1 wherein said cover securing means further comprises:

a first flange member formed integrally with said secondary tank;

said first flange member including said at least one aperture;

a second flange member formed integrally with said primary tank;

said second flange member having at least one additional aperture; and each said additional aperture being alignable with a cover aperture and an aperture in said first flange member and further forming part of said mating set of apertures.

4. A container in accordance with claim 1 wherein said securing means further comprises:

a gasket intermediate said cover and said second flange member;

said gasket having at least one further aperture alignable with a respective one of said mating set of apertures.

5. A container in accordance with claim 3 wherein:

said cover has a turned down lip portion;

said lip portion concealing said cover securing means; and each said flange extends in a direction toward said lip portion.

6. A container in accordance with claim 3 wherein:

said first and second flange members each extend substantially about the periphery of the respective primary and secondary tanks; and each said flange member has a plurality of apertures aligned with respective apertures in said other flange and said cover so as to form a plurality of mating sets.

7. A container in accordance with claim 3 wherein each said fastener engaging means comprises a clip member having means for threadably receiving a threaded portion of a fastener.

8. A container in accordance with claim 7 wherein:

each said clip member surrounds at least a portion of said first flange member and comprises a substantially U-shaped member with two leg portions; and each of said legs containing a further aperture alignable with a respective mating set of apertures.

9. A container in accordance with claim 1 wherein said cover securing means comprises:

said flange member forming part of said secondary tank; and said flange member extending inwardly toward a central portion of said secondary tank.

10. A container in accordance with claim 9 wherein said flange member extends substantially about the periphery of said secondary tank.

11. A container in accordance with claim 9 wherein said secondary tank has two opposed inwardly directed flange portions with each said flange portion having at least one aperture for mating with an aperture in said cover and for receiving a portion of a fastener.

12. A container in accordance with claim 9 wherein each said fastener engaging means comprises a clip member having means for threadably receiving a threaded portion of said fastener.

13. A container in accordance with claim 12 wherein each said clip member is substantially U-shaped and surrounds a portion of said flange member.

14. A container in accordance with claim 9 further comprising gasket means intermediate said flange member and said cover, said gasket means having at least one aperture for receiving a portion of one of said fasteners.

15. A container in accordance with claim 1 wherein said cover securing means further comprises:

each said tank having two opposed, integrally formed flange members with at least one aperture in each said flange portion;

said flange member associated with said primary tank overlapping said flange members associated with said secondary tank;

each said overlapping flange members having an aligned set of apertures; and each said fastener passing through said aligned set of apertures and a respective aperture in said cover.

* * * * *